US006014954A

United States Patent [19]

Kleeman et al.

[11] Patent Number: 6,014,954

[45] Date of Patent: Jan. 18, 2000

[54] FINE ADJUSTMENT OF THE SLOW SPEED OPERATION OF AN ENGINE

[75] Inventors: Robert Kleeman, Fond du Lac; David D. Liegeois, North Fond du Lac, both of Wis.

[73] Assignee: Brunswick Corporation, Lake Forest, Ill.

[21] Appl. No.: 08/994,181

[22] Filed: Dec. 19, 1997

[51] Int. Cl.[7] ..... F02M 3/07

[52] U.S. Cl. ..... 123/339.13; 440/87

[58] Field of Search ..... 123/339.13; 440/87

[56] References Cited

U.S. PATENT DOCUMENTS

| | | | |
|---|---|---|---|
| 2,190,736 | 2/1940 | Schweiss | 123/339.13 |
| 3,788,288 | 1/1974 | Harrison et al. | 123/339.13 |
| 4,111,174 | 9/1978 | Fitzner et al. | 123/148 |
| 4,337,053 | 6/1982 | Stevens | 440/87 |
| 4,502,436 | 3/1985 | Bonfiglioli et al. | 123/339.13 |
| 4,590,906 | 5/1986 | Uriuhara et al. | 123/339.13 |
| 4,784,096 | 11/1988 | Eberline | 123/179 |
| 4,902,448 | 2/1990 | Phillips | 261/65 |
| 4,940,031 | 7/1990 | Mann | 123/339.13 |
| 5,522,362 | 6/1996 | Motose | 123/339.13 |

FOREIGN PATENT DOCUMENTS

| | | | |
|---|---|---|---|
| 57-105533 | 7/1982 | Japan | 123/339.13 |

*Primary Examiner*—Erick R. Solis
*Attorney, Agent, or Firm*—William D. Lanyi

[57] ABSTRACT

A slow speed adjustment mechanism is provided that allows an internal combustion engine to be manually adjusted to operate at a slow speed which is slightly faster than the idle speed of the engine. A tubular member is provided with an outer threaded surface and an inner threaded aperture and is rigidly attached to a support plate mounted on the engine. An adjustment head is provided with threads that mate with the threads of the inner threaded aperture of the tubular member. Rotation of the adjustment head moves it axially relatively to an axial end of the tubular member. A flexible shaft can be attached to the adjustment head to allow manual rotation of the adjustment head, whereby the idle speed of the engine can be modified for purposes of trolling or other uses which require a slow operation of the engine at a speed which is slightly greater than its idle speed.

10 Claims, 4 Drawing Sheets

FINE ADJUSTMENT OF THE SLOW SPEED OPERATION OF AN ENGINE

BACKGROUND OF THE INVENTION

1. Field of the Invention

The present invention is generally related to an idle setting mechanism for an internal combustion engine and, more specifically, to a means by which the speed of an engine can be accurately set to a very low magnitude which is slightly greater than the idle speed of the engine.

2. Description of the Prior Art

Many different types of internal combustion engines are well-known to those skilled in the art. Some internal combustion engines are used to provide the motive power for an outboard motor.

Most internal combustion engines provide an adjustment mechanism by which the idle speed of the engine can be set. Typically, an idle stop screw is used to define a position against which a throttle shaft is stopped from rotating in response to a spring when a manual force is removed from the throttle control. In other words, most engines are arranged to allow manual control of a throttle position so that the operating speed of the engine can be controlled. When the throttle control is set to its minimum position, a component attached to the throttle shaft rotates into contact with the stop screw and prevents further rotation of the throttle shaft. By adjusting the idle stop set screw, the engine speed at idle can be selected. This technique for determining the idle speed of an engine is very wellknown to those skilled in the art.

U.S. Pat. No. 4,902,448, which issued to Phillips on Feb. 20, 1990, describes a cam and idle speed adjustment for a marine engine. A marine carburetor is provided with an adjustment screw that is mounted on the throttle lever. It is engageable with the cam follower in such a manner that movement of the adjustment screw urges the cam follower into engagement with the surface of the throttle cam, at which point continued movement of the screw results in movement of the throttle lever so that the throttle plate may be adjusted to an idle position.

U.S. Pat. No 5,522,362, which issued to Motose on Jun. 4, 1996, discloses an idle control arrangement for an engine. The idle speed control arrangement embodies an idle air passage formed in a member of the induction system that is downstream of a throttle valve. The idle air passage is formed by a groove in a face of the member that is closed by engagement with another member of the induction system. The idle speed is controlled by controlling the flow of air to the idle passage from an atmospheric air inlet.

U.S. Pat. 4,784,096, which issued to Eberline on Nov. 15, 1988, describes a carburetor idle vent control. A carburetor for an internal combustion engine includes a supplemental fuel chamber and a fuel injector valve, manually or remotely actuated, to inject a charge of fuel into the fuel induction chamber of an associated engine and provide a continuing fuel supply to the engine, over and above the normal carburetor system, to allow the engine to reach a warm-up stage and prevent stalling until such stage is reached where normal carbonation can take over. Automatic refill and vent valves permit fuel recharge of the supplemental fuel chamber to ensure readiness of the chamber for starting at all times. An idle vent is arranged to be closed electrically or otherwise in order to facilitate the starting cycle.

U.S. Pat. No. 4,337,053, which issued to Stevens on Jun. 29, 1982, describes an idle adjustment control and sculptured twist grip throttle control handle for a marine propulsion device. The marine propulsion device comprises a marine propulsion unit including an engine and rotatably mounted propeller which is operatively connected to the engine. The engine has a throttle that is moveable between an idle position and an advanced position. A steering tiller is attached to the marine propulsion unit and a throttle grip is rotatably attached on the steering tiller. The throttle grip has an exterior gripping surface. A throttle linkage assembly is operatively connected to the throttle grip and the throttle from moving the throttle between the idle position and the advanced position in response to rotation of the throttle grip. An idle adjustment assembly is carried by the throttle grip and is operatively connected with the throttle linkage assembly for adjusting the low operational engine speed above the true idle of the engine. A portion of the idle adjustment assembly protrudes outwardly from the sides of the exterior gripping surface to permit the operator to operate the idle adjustment assembly without removing his or her hands from the throttle grip. The gripping surface of the throttle grip is contoured to include a first surface area spaced generally at a first radial distance from the rotational axis of the throttle grip and a second surface area which is faced angularly from the first surface area with respect to the rotational axis and generally at a second radial distance from the rotational axis which is different from the first distance. The operator is thus able to judge the approximate position of the throttle by visual and/or tactile reference to the contoured throttle grip.

U.S. Pat. No. 4,111,174, which issued to Fitzner et. al. on Sep. 5, 1978, discloses an admission system with idle speed governor apparatus. An alternator driven capacitive discharge ignition system includes a tachometer circuit which monitors the speed dependent repetition rate of discharge of an internal trigger power supply. The tachometer circuit causes the triggering threshold bias to be reduced below idle speed to electronically advance the timing. The ignition circuit includes a triggering threshold bias capacitor in series with the trigger pulse source and a trigger power supply having a pilot capacitor to alternately fire a pair of ignition silicone controlled rectifiers. The pilot capacitor is charged in series with an RC filter network of a "bucket" tachometer circuit to create a speed signal voltage proportional to engine speed with the pilot capacitor functioning as the bucket capacitor. The speed signal is a voltage which is positive relative to a common signal ground while the threshold bias capacitor voltage is negative to such signal ground. The speed signal is applied to the gate of a P-channel depletion mode junction field effect transistor (JFET). The source-to-drain channel of the transistor is connected in parallel with the threshold bias capacitor. Below the selected idle speed, the source-to-drain channel resistance provides a maximum bleed current to the threshold bias capacitor, thereby reducing the triggering threshold voltage and creating an automatic spark advance. As the engine speeds up, the source-to-drain resistance increases and virtually eliminates the bleed current at speeds slightly above idle.

With engines used for marine propulsion, such as outboard motors, it is sometimes desirable to operate the engines at very low speeds which are only slightly higher than the idle speed of the engine. For example, some fishermen desire to operate the outboard motor in gear but at a very low speed to allow a fishing technique that is referred to as trolling. During the trolling operation, the fisherman typically pulls a lure through the water behind the boat, and the speed of the lure moving through the water is generally determined by the speed of the boat. When used in this way, it is desirable that the outboard motor be operated at a very slow speed, but at a speed which is faster than normal idle. Usually, when a fisherman is trolling, the speed of the boat is manually controlled by continual adjustment of the handle grip on the tiller which serves as the throttle control. It is often very difficult to maintain a constant trolling speed in this manner.

It would, therefore, be highly desirable if a means could be provided to adjust the slow speed operation of an engine in a way that maintains a constant slow speed without the need for continual throttle adjustment.

SUMMARY OF THE INVENTION

An engine made in accordance with the present invention comprises a throttle plate which is connected to a throttle shaft. Rotation of the throttle shaft about its centerline causes the throttle plate to change the effective cross-sectional area of a throttle body and thereby affect the air flowing into the engine. By adjusting the relative angular position of the throttle plate within the throttle body, the speed of an engine can be controlled. The present invention further comprises a controller which is operatively connected to the throttle shaft to select an operating speed of the engine by rotating the throttle shaft in a first direction to decrease the engine speed and in a second direction to increase the engine speed. Typically, this controller is a hand-operated grip on a tiller handle of an outboard motor, but it can also be a throttle control associated with a stem drive system.

The present invention also comprises a first stop mechanism for limiting the movement of the throttle shaft to a first position in the first direction. This first stop position therefore selects the first idle speed of the engine.

The present invention further comprises a second stop mechanism for limiting the movement of the throttle shaft to a second position in the first direction. This selects a second idle speed of the engine. The second stop mechanism is moveable relative to the first stop mechanism, and the second idle speed is faster than the first idle speed.

In a particularly preferred embodiment of the present invention, the first stop mechanism comprises a tubular member having an outer threaded surface and an inner threaded aperture. An axial end of the first stop mechanism defines the first position in cooperation with an adjustment head which is threaded into the inner threaded aperture. The adjustment head is moveable, along a line which is generally coaxial with a centerline of the tubular member, by rotating the adjustment head relative to the tubular member.

The first position, described above, is defined by the adjustment head being fully retracted into contact with the axial end of the tubular member and the second position, also described above, is defined by the adjustment head being moved away from the axial end of the tubular member.

In one particularly preferred embodiment of the present invention, a flexible shaft is provided with a first end attached to the adjustment head and a second end attached to a knob. The knob is manually rotatable to cause the flexible shaft and the adjustment head to rotate and move axially relative to the tubular member along the line which is coaxial with a centerline of the tubular member.

BRIEF DESCRIPTION OF THE DRAWINGS

The present invention will be more fully and completely understood from a reading of the description of the preferred embodiment in conjunction with the drawings, in which.

DESCRIPTION OF PREFERRED EMBODIMENT

Figure 1:
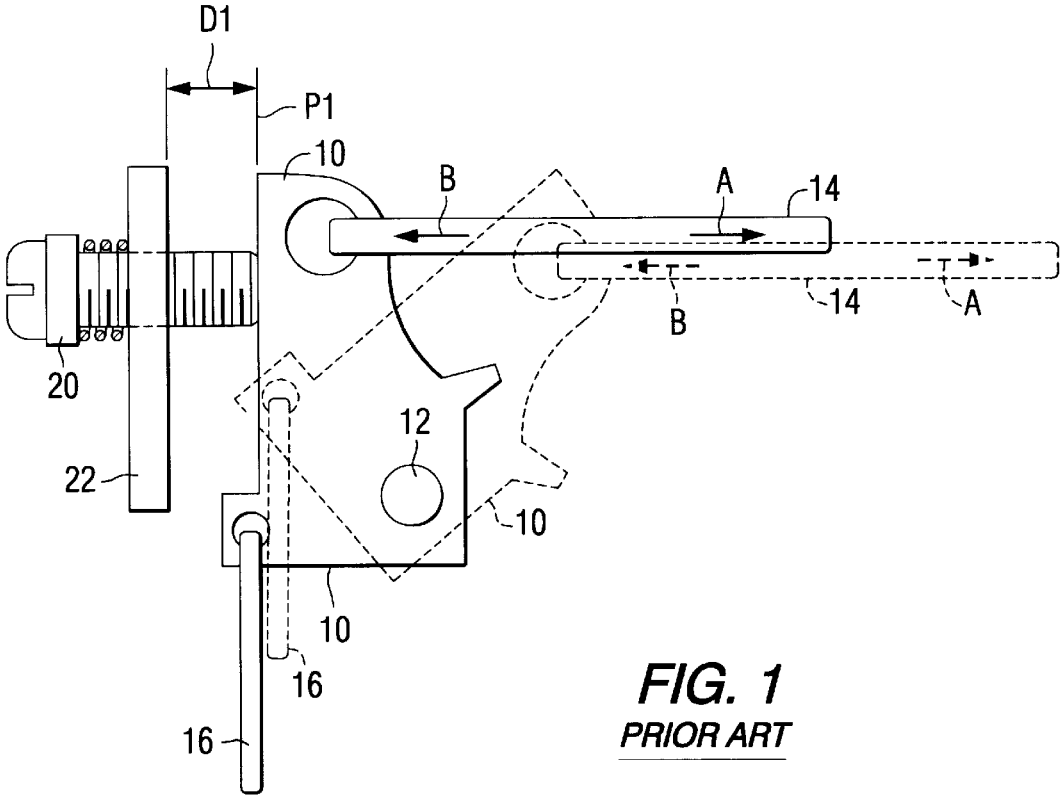
FIG. 1 PRIOR ART
FIG. 1 is an illustration of an idle speed adjustment mechanism known to those skilled in the art.

Throughout the description of the preferred embodiment of the present invention, like components will be identified by like reference numerals.

In FIG. 1 a throttle shaft end plate 10 is rigidly attached to an end of a throttle shaft 12. A throttle linkage rod 14 is connected to the throttle shaft end plate 10 so that movement of the throttle linkage rod 14 in a direction represented by arrow A will cause the throttle shaft end plate 10 to rotate in a clockwise direction about the centerline of the throttle shaft 12. In a typical application, the clockwise direction of the throttle shaft end plate 10 will cause an increase in the speed of the engine associated with the throttle shaft 12.

An accelerator pump linkage rod 16 is also attached to the throttle shaft end plate 10. The dashed representation in FIG. 1 of the throttle shaft end plate 10, the throttle linkage rod 14, and the accelerator pump linkage rod 16 shows the rotated position of the assembly in response to a force on the throttle linkage rod 14 in the direction of arrow A. When the throttle linkage rod 14 moves in the direction represented by arrow B, the throttle shaft 12 and its throttle shaft end plate 10 rotate in a counterclockwise direction, and the speed of the engine is decreased.

When the throttle shaft end plate 10 is rotated in a counterclockwise direction, it can eventually move against an end of an idle stop screw 20. This is defined as a first position P1 in FIG. 1, and the precise location of position P1 is determined by the degree to which the idle stop screw 20 is threaded through an idle stop screw support plate 22. By changing the threaded relationship between the idle stop screw 20 and the idle stop screw support plate 22, distance D1 can be changed. A change in the magnitude of distance D1 will result in a change of the position P1. In other words, the throttle shaft end plate 10 will rotate in a counterclockwise direction, typically under the influence of a spring, until the throttle shaft end plate moves into contact with the end of the idle stop screw 20. Position P1 determines the idle speed of the engine. In most types of internal combustion engines, the mechanism shown in FIG. 1 is used in some form or another to set the idle speed of the engine.

Figure 2:
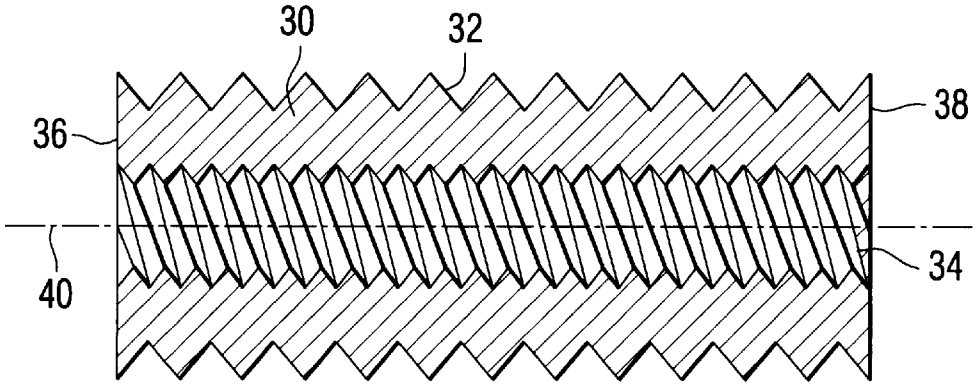
FIG. 2 shows a tubular member used in conjunction with the preferred embodiment of the present invention.

FIG. 2 shows a tubular member 30 which has an outer threaded surface 32 and an inner threaded aperture 34. The tubular member 30 is shown in section view in FIG. 2. It has two axial ends, 36 and 38, and the inner threaded aperture 34 is aligned with an axis 40.

Figure 3:
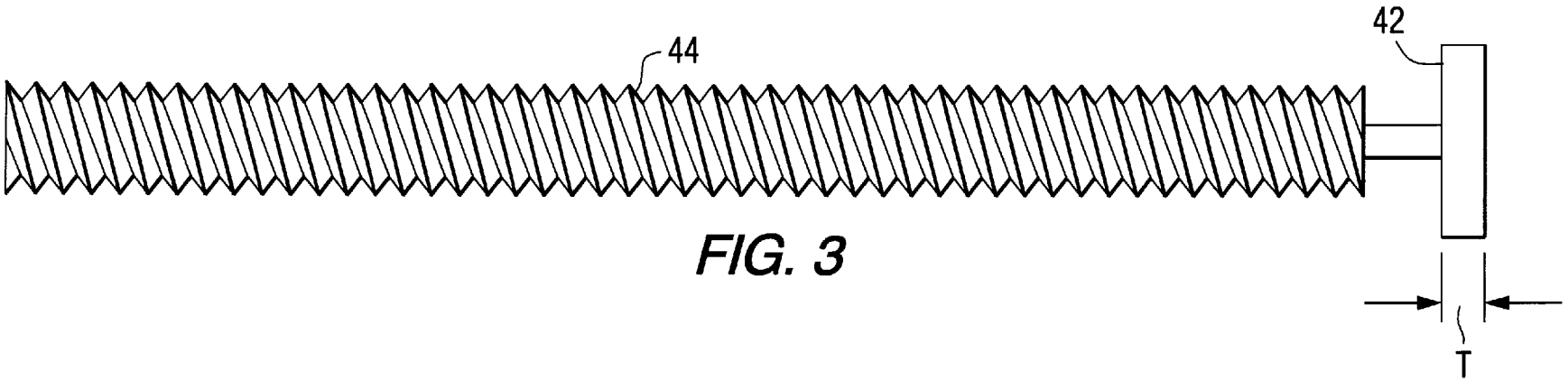
FIG. 3 shows an adjustment head with a threaded portion that can be threaded in mating association with an internal threaded aperture of the tubular member of the present invention.

FIG. 3 shows an adjustment head 42 that is provided with threads 44 that allow the adjustment head to be threaded into the inner threaded aperture 34 described above in conjunction with FIG. 2. By threading the adjustment head into the inner threaded aperture 34, each rotation of the adjustment head relative to the tubular member 30 will cause the adjustment head to move in a direction generally parallel with axis 40. As will be described in greater detail below, a portion of the adjustment head 42 is provided with a thickness T.

Figure 4:
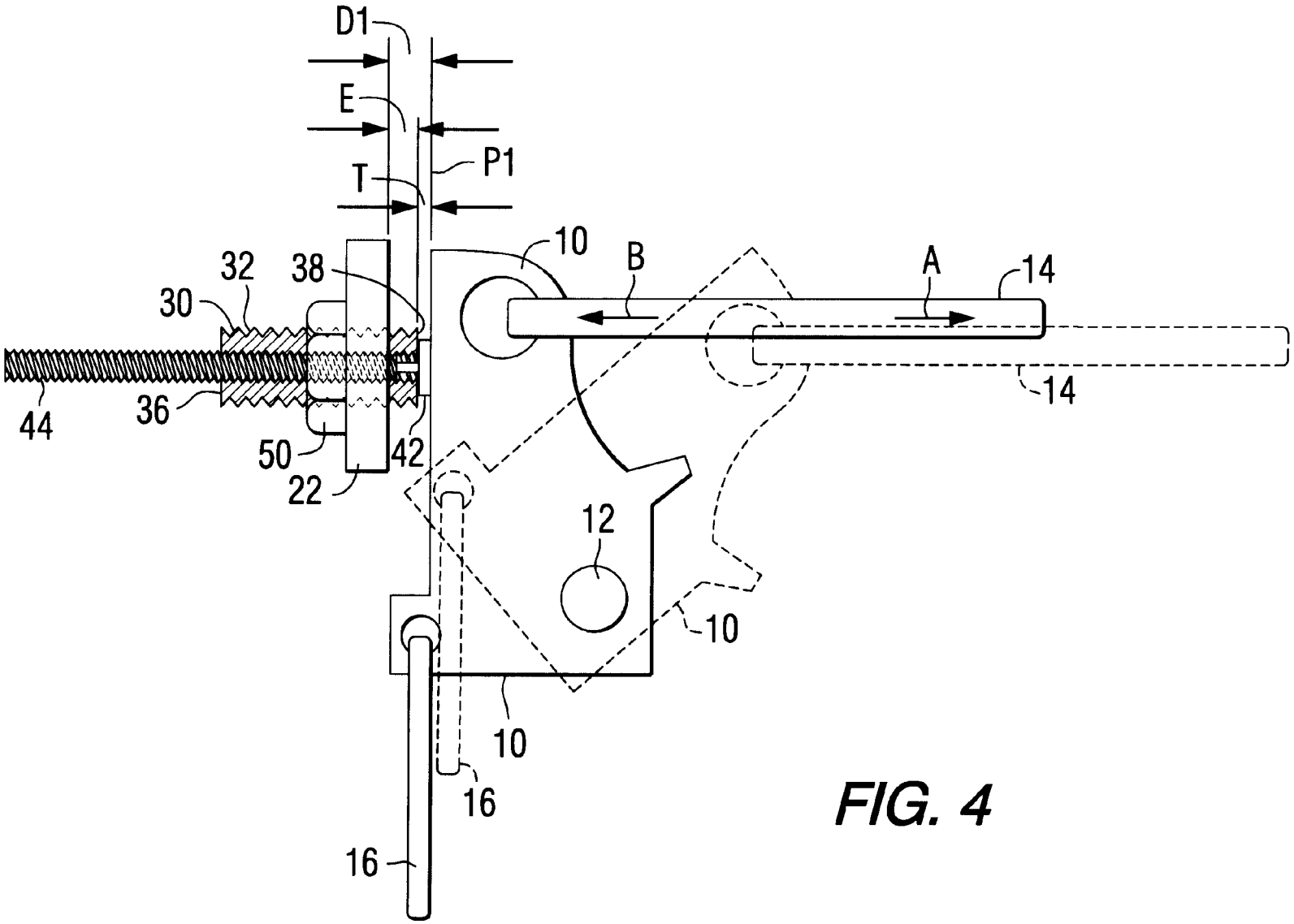
FIG. 4 shows an assembly which incorporates the present invention and which is set at a first idle speed.

FIG. 4 shows the tubular member 30 threaded into the idle stop screw support plate 22. The idle stop screw 20, described above in conjunction with FIG. 1, has been removed from the support plate 22 and replaced by the tubular member 30 whose outer threaded surface 32 is threaded into a threaded opening in the support plate 22. A nut 50 is used to retain the tubular member 30 in a precise position relative to the support plate 22. Distance D1, described above in conjunction with FIG. 1, defines the first stop position P1. However, when the tubular member 30 is used for these purposes, dimension D1 is determined by the sum of two magnitudes. First, the amount E of the tubular member 30 which extends outward from the support plate 22 in the direction toward the right in FIG. 4 and also the thickness T of the adjustment head 42. When the adjustment head 42 is retracted completely back against the axial end 38 of the tubular member 30, the combined distances described immediately above define the magnitude of dimension D1 and also define the first stop position P1. In other words, when the throttle linkage rod 14 is moved in the direction of arrow B and the throttle shaft end plate 10 is rotated in a counterclockwise direction about the centerline of the throttle shaft 12, this counterclockwise rotation is limited to the first position P1 when the throttle shaft end plate 10 moves into contact with the adjustment head 42. The first position P1 can be adjusted by rotating the tubular member 30 relative to the support plate 22 and changing the magnitude of dimension E, which is the extension of the axial end 38 from the right most surface of the support plate 22. The dashed line representation in FIG. 4 shows the position of the throttle shaft end plate 10 in response to a throttle controller moving the throttle linkage rod 14 in a direction toward the right. As a result of the positioning of the adjustment head 38 shown in FIG. 4, the throttle shaft end plate 10 will always return to the first position P1 when the throttle controller attempts to decease the speed of the engine. This sets the basic idle speed of the engine.

Figure 5:
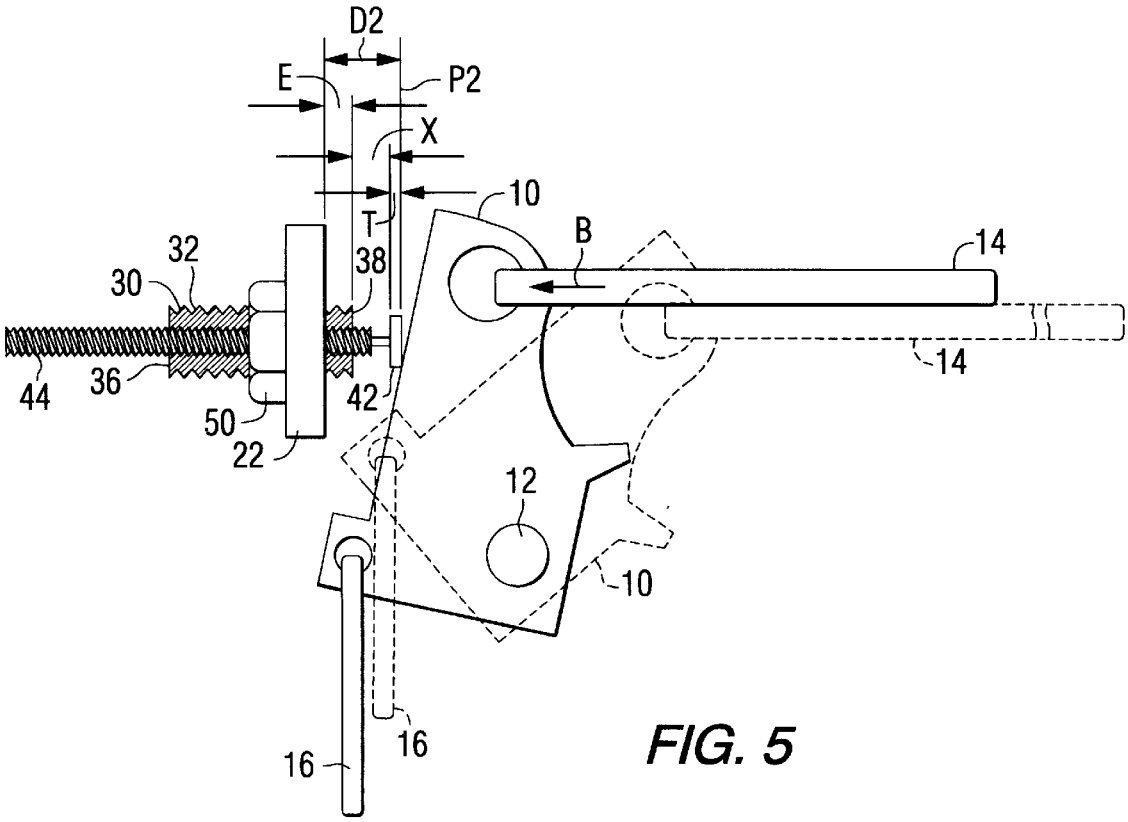
FIG. 5 shows the assembly of FIG. 4 altered to adjust the idle speed to a second magnitude.

FIG. 5 is a slightly exaggerated illustration which shows the operation of the present invention which enables the selection of a second position which results in a second idle speed of the engine because it creates a second position P2 at which the throttle shaft end plate 10 comes to rest against the adjustment head 42. In FIG. 5, the tubular member 30 is in the same position relative to the support plate 22 as it is shown in FIG. 4. In other words, dimension E does not change from FIG. 4 to FIG. 5. Also, the thickness T of the adjustment head 42 is constant. However, the position of the adjustment head 42 relative to the axial end 38 is changed because the threaded surface 44 of the adjustment head 42 has been rotated relative to the tubular member 30. Because of the threaded association between the threads 44 of the adjustment head 42 and the inner threaded aperture, the adjustment head 42 is moved toward the right in FIG. 5 compared to its position in FIG. 4. As a result, dimension X is added to the distance between the adjustment head 42 and the right most surface of the support plate 22. This dimension D2 defines a second position P2. Therefore, when the throttle linkage rod 14 is moved in the direction of arrow B, the throttle shaft end plate 10 rotates in a counterclockwise direction until it moves into contact with the adjustment head 42. At that position, it is stopped from further rotation, and the speed of the engine is maintained at a higher magnitude than that which is defined by the first position P1 described above in conjunction with FIG. 4.

With continued reference to FIGS. 4 and 5, it should be noted that a rotation of the adjustment head 42 relative to the tubular member 30 will cause the adjustment head to move toward the left and eventually into contact with the axial end 38 of the tubular member 30. When this is done, dimension D2 is decreased to the magnitude of dimension D1, and the original first position P1 is set as the idle position for the engine.

In a typical application of the present invention, dimension E is not normally changed, but remains fixed once the engine has been properly calibrated. Dimension X changes as a result of the manual control of the fisherman who wishes to set the speed of the engine at a relatively slow magnitude, but at a speed which is greater than its normal idle speed. The present invention allows the adjustment head 42 to be moved toward the right to define a second position P2 that results in this slow speed which is greater than the idle speed at position P1.

Figure 6:
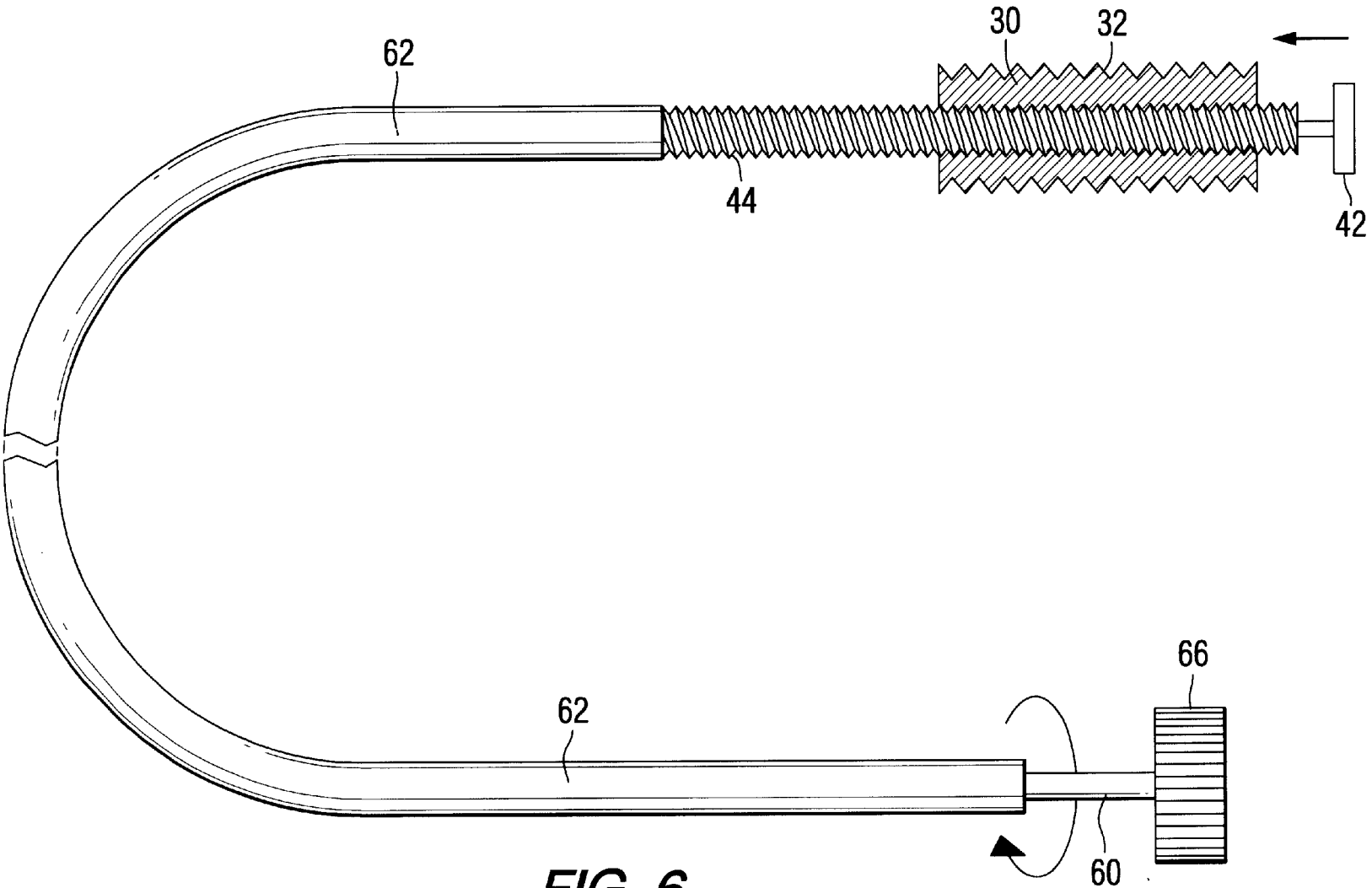
FIG. 6 shows a portion of the present invention incorporated in a flexible shaft.

FIG. 6 shows a particularly preferred embodiment of the present invention which incorporates a flexible shaft 60 disposed within a tubular housing 62. The flexible shaft 60 and flexible housing 62 are of the type generally known to those skilled in the art and used in many applications such as odometer mechanisms. The flexible shaft 60, which typically comprises several wires wrapped around by another wire, is connected to the threaded portion 44 of the adjustment head 42 so that rotation of the flexible shaft 60 will cause the adjustable head 42 to rotate. Depending on the direction of rotation of the flexible shaft 60, the position of the adjustment head 42 relative to the axial end 38 of the tubular member 30 will change. As a result, dimension X described above in conjunction with FIG. 5 will change, and this will result in a change of the second position P2. A knob 66 is provided to allow manual adjustment of the mechanism. In use, a fisherman can rotate knob 66 to rotate the flexible shaft 60. This causes the adjustment head 42 to rotate and alters its axial position relative to the tubular member 30. As a result, the slow speed operation of the engine can be accurately set to a speed which is slightly greater than the idle speed of the engine. In a typical application, this mechanism can be used for trolling at slow speeds. By allowing the precise setting of the second idle speed, the present invention moves the uncertainty of speed adjustments that would otherwise be made by manual repositioning of a throttle grip on a tiller of an outboard motor. The slow speed operation of the engine can be set precisely, and the mechanism will maintain that speed until manually readjusted.

The provision of fine threads in the inner threaded aperture 34 of the tubular member 32 allows the adjustment head 42 to be accurately positioned because rotation of the knob 66 will result only in a slight axial movement of the adjustment head 42.

Although the present invention has been described in considerable detail and illustrated to show one particularly preferred embodiment, it should be understood that alternative embodiments are also within its scope.

We claim:

1. An engine speed control system, comprising:

a throttle plate connected to a throttle shaft;

a controller which is operatively connected to said throttle shaft to select an operating speed of said engine by rotating said throttle shaft in a first direction to decrease said engine speed and in a second direction to increase said engine speed;

a first stop mechanism, for limiting the movement of said throttle shaft to a first position in said first direction, which selects a first idle speed of said engine; and a second stop mechanism, for limiting the movement of said throttle shaft to a second position in said first direction, which selects a second idle speed of said engine, said second stop mechanism being movable relative to said first stop mechanism, said second idle speed being faster than said first idle speed, said first stop mechanism comprises a generally tubular member having an outer threaded surface and an inner threaded aperture, said second stop mechanism being disposed in threaded association within said inner threaded aperture, an axial end of said first stop mechanism defining said first position in cooperation with an adjustment head of said second stop mechanism being threaded into said inner threaded aperture.

2. The system of claim 1, wherein:

said adjustment head is movable, along a line which is coaxial with a centerline of said tubular member, by rotating said adjustment head relative to said tubular member.

3. The system of claim 2, wherein:

said first position is defined by said adjustment head being fully retracted into contact with said axial end of said tubular member and said second position is defined by said adjustment head being moved away from said axial end of said tubular member.

4. The system of claim 3, further comprising:

a flexible shaft having a first end attached to said adjustment head and a second end attached to a knob, said knob being manually rotatable to cause said flexible shaft and said adjustment head to rotate and move axially relative to said tubular member along said line which is coaxial with a centerline of said tubular member.

5. An engine speed control system, comprising:

a throttle plate connected to a throttle shaft;

a controller which is operatively connected to said throttle shaft to select an operating speed of said engine by rotating said throttle shaft in a first direction to decrease said engine speed and in a second direction to increase said engine speed;

a first stop mechanism, for limiting the movement of said throttle shaft to a first position in said first direction, which selects a first idle speed of said engine; and a second stop mechanism, for limiting the movement of said throttle shaft to a second position in said first direction, which selects a second idle speed of said engine, said second stop mechanism being movable relative to said first stop mechanism, said second idle speed being faster than said first idle speed, said first stop mechanism comprising a tubular member having an outer threaded surface and an inner threaded aperture, said second stop mechanism being threaded into said inner threaded aperture with an axial end of said first stop mechanism defining said first position in cooperation with an adjustment head threaded into said inner threaded aperture, said adjustment head being movable, along a line which is coaxial with a centerline of said tubular member, by rotating said adjustment head relative to said tubular member.

6. The system of claim 5, wherein:

said first position is defined by said adjustment head being fully retracted into contact with said axial end of said tubular member and said second position is defined by said adjustment head being moved away from said axial end of said tubular member.

7. The system of claim 6, further comprising:

a flexible shaft having a first end attached to said adjustment head and a second end attached to a knob, said knob being manually rotatable to cause said flexible shaft and said adjustment head to rotate and move axially relative to said tubular member along said line which is coaxial with a centerline of said tubular member.

8. An engine speed control system, comprising:

a carburetor throttle plate connected to a throttle shaft;

a controller which is operatively connected to said throttle shaft to select an operating speed of said engine by rotating said throttle shaft in a first direction to decrease said engine speed and in a second direction to increase said engine speed;

a first stop mechanism, for limiting the movement of said throttle shaft to a first position in said first direction, which selects a first idle speed of said engine; and a second stop mechanism, for limiting the movement of said throttle shaft to a second position in said first direction, which selects a second idle speed of said engine, said second stop mechanism being movable relative to said first stop mechanism, said second idle speed being faster than said first idle speed, said first stop mechanism comprising a tubular member having an outer threaded surface and an inner threaded aperture, an axial end of said first stop mechanism defining said first position in cooperation with an adjustment head of said second stop mechanism which is threaded into said inner threaded aperture, said adjustment head being movable, along a line which is coaxial with a centerline of said tubular member, by rotating said adjustment head relative to said tubular member.

9. The system of claim 8, wherein:

said first position is defined by said adjustment head being fully retracted into contact with said axial end of said tubular member and said second position is defined by said adjustment head being moved away from said axial end of said tubular member.

10. The system of claim 9, further comprising:

a flexible shaft having a first end attached to said adjustment head and a second end attached to a knob, said knob being manually rotatable to cause said flexible shaft and said adjustment head to rotate and move axially relative to said tubular member along said line which is coaxial with a centerline of said tubular member at said third pair of electrical contacts, said recharger being shaped to be removably attached to said battery to dispose said second and third pairs of electrical contacts in electrical communication with each other.

* * * * *